US008950659B2

(12) United States Patent
Markovic

(10) Patent No.: US 8,950,659 B2
(45) Date of Patent: Feb. 10, 2015

(54) MULTIPLE SPLIT PACKAGE WITH CLOSING FLAP

(75) Inventor: Nevenka Markovic, Nutley, NJ (US)

(73) Assignee: Intercontinental Great Brands LLC, East Hanover, NJ (US)

( * ) Notice: Subject to any disclaimer, the term of this patent is extended or adjusted under 35 U.S.C. 154(b) by 164 days.

(21) Appl. No.: 13/508,176

(22) PCT Filed: Nov. 9, 2010

(86) PCT No.: PCT/US2010/055920

§ 371 (c)(1),
(2), (4) Date: Jun. 7, 2012

(87) PCT Pub. No.: WO2011/059941

PCT Pub. Date: May 19, 2011

(65) Prior Publication Data

US 2012/0241512 A1 Sep. 27, 2012

Related U.S. Application Data

(60) Provisional application No. 61/280,906, filed on Nov. 10, 2009.

(51) Int. Cl.

| | |
|---|---|
| ***B65D 5/486*** | (2006.01) |
| ***B65D 85/60*** | (2006.01) |
| ***B65D 5/54*** | (2006.01) |

(52) U.S. Cl.

CPC ..... *B65D 85/60* (2013.01); *B65D 5/5445* (2013.01)

USPC ..... 229/120.09; 206/38; 206/257; 206/264; 229/120.18

(58) Field of Classification Search

USPC ..... 229/87.07, 120.01, 120.09, 120.18, 229/120.011; 206/38, 256, 257, 264, 800

See application file for complete search history.

(56) References Cited

U.S. PATENT DOCUMENTS

| | | | | |
|---|---|---|---|---|
| 437,042 | A * | 9/1890 | Peck | 229/120.09 |
| 2,074,451 | A | 3/1937 | Berberian | |
| 2,541,258 | A * | 2/1951 | Lane | 229/120.09 |
| 4,070,489 | A * | 1/1978 | Pahnke | 229/120.09 |
| 4,377,237 | A | 3/1983 | Pawlowski | |
| 4,932,534 | A * | 6/1990 | Focke et al. | 229/120.011 |
| 7,159,717 | B2 * | 1/2007 | Aldridge et al. | 206/800 |
| 8,141,707 | B2 * | 3/2012 | Robbins et al. | 229/120.011 |
| 2010/0187145 | A1 * | 7/2010 | Mezzini | 229/87.07 |

FOREIGN PATENT DOCUMENTS

| | | |
|---|---|---|
| GB | 448580 | 6/1936 |
| JP | 4212058 B2 | 1/2009 |
| WO | 2005/110865 A1 | 11/2005 |
| WO | 2008/153954 A1 | 12/2008 |

* cited by examiner

*Primary Examiner* — Gary Elkins

(74) *Attorney, Agent, or Firm* — Hoffmann & Baron, LLP

(57) ABSTRACT

A package assembly (10) provides for enclosing an array of aligned products (14) in a package housing having a pair of product accommodating pockets (12) The pockets are disposed on opposite sides of a fold line (20) for foldable movement between a flat closed condition and a folded open condition for allowing dispensing of the products (14) from the pockets (12). The housing further includes an openable flap (22) disposed over the pockets in the flat condition for closing the pockets, wherein the flap (22) extends from one of the pockets and wherein the other of the pockets includes a slot (25) for receipt of a distal end (22*a*) of the flap (22) in the closed condition.

20 Claims, 5 Drawing Sheets

MULTIPLE SPLIT PACKAGE WITH CLOSING FLAP

CROSS REFERENCE TO RELATED APPLICATIONS

This application is the National Stage of International Application Ser. No. PCT/US2010/055920, which designates the U.S., filed Nov. 9, 2010, which claims the benefit of U.S. Provisional patent application Ser. No. 61/280,906 filed on Nov. 10, 2009, the contents of all of which are incorporated herein by reference in their entirety.

FIELD OF THE INVENTION

The present invention relates generally to a package assembly for containing and dispensing a plurality of consumable products. More particularly, the present invention relates to a package assembly having a pair of foldable product accommodating pockets for permitting access to the products contained in each of the pockets.

BACKGROUND OF THE INVENTION

Certain consumable products, such as slabs of chewing gum, may be housed in a package where the gum slabs are arranged to allow easy dispensing of an individual slab therefrom. In addition to permitting access to the gum slabs contained within the housing, the housing should be recloseable so that the package can be opened and closed repeatedly to allow convenient dispensing of the remaining gum slabs. Each time the package is reopened, the package should present the remaining gum slabs in a position for ease of removal. Moreover, as the consumer would carry the package until the products are all dispensed, the package should be compact and convenient to carry.

It is therefore desirable to provide a product package assembly which is openable and recloseable and allow compact, easy dispensing of the individual products therefrom.

SUMMARY OF THE INVENTION

A package assembly is provided which includes a package housing having a pair of product accommodating pockets. The pockets are disposed on opposite sides of a fold line for foldable movement from a flat closed condition to a folded open condition allowing dispensing of the products from the pockets. The housing further includes an openable flap disposed over the pockets in the flat condition for closing the pockets. The openable flap extends from one of the pockets and wherein the other of the pockets includes a slot for receipt of a distal end of the flap in the closed condition.

In another embodiment, a blank is provided for forming a package housing for a pair of product accommodating opposed pockets. The blank includes a pentagonal flap foldably attached to a first end wall and the first end wall being foldably attached to a first back wall main surface. A second back wall main surface being foldably attached to and extending between the first back wall main surface and an end flap. A first side flap being foldably attached to and extending between the first back wall main surface and a first front surface. A third side flap being foldably attached to and extending between the first front surface and the side tab. A second side flap being foldably attached to and extending between the second back wall main surface and a second front surface. A fourth side flap being foldably attached to and extending between the second front surface and a fourth side tab, and the second front surface includes a slot therethrough to mate with an end of the flap once assembled into the package housing.

A further embodiment includes a method of forming a package housing including a pair of pockets for storing product in a face-to-face configuration. The steps include cutting a blank from a sheet, the blank includes a pentagonal flap foldably attached to a first end wall and the first end wall being foldably attached to a first back wall main surface. A second back wall main surface being foldably attached to and extending between the first back wall main surface and an end flap. A first side flap being foldably attached to and extending between the first back wall main surface and a first front surface. A third side flap being foldably attached to and extending between the first front surface and the side tab. A second side flap being foldably attached to and extending between the second back wall main surface and a second front surface. A fourth side flap being foldably attached to and extending between the second front surface and a fourth side tab, and the second front surface includes a slot therethrough to mate with an end of the flap once assembled into the package housing. Next, folding the first back wall main surface and the second back wall main surface along a back fold line, wherein the first back wall main surface and the second back wall main surface are perpendicular to the first side flap and the second side flap. The next step is folding the first side flap and the second side flap along a side fold line, wherein the first side flap and the second side flap are perpendicular to the first front surface and the second front surface, and the first front surface and the second front surface are spaced apart, parallel and aligned with the first back wall main surface and the second back wall main surface. A further step is folding the third side flap and the fourth side flap along a third fold line, wherein the third side flap and the fourth side flap are perpendicular to the first front surface and the second front surface, and the third side flap and the fourth side flap are spaced apart, parallel and aligned with the first side flap and the second side flap. Next, folding the side tab and the fourth side tab along a side tab fold line, wherein the side tab and the fourth side tab are parallel with the first back wall main surface and the second back wall main surface. Then, adhering the side tab to the first back wall main surface to form a first pocket with an open end, and adhering the side tab to the first back wall main surface to form a second pocket with an open end. Further, folding the end flap along an end flap line, wherein the end flap is perpendicular to the second back wall main surface, the end flap extends between the second back wall main surface and the second front wall main surface to close the open end of the second pocket. The next step is folding the sidewall along a first end wall fold line, wherein the first end wall is perpendicular to the first back wall main surface, the first end wall extends between the first back wall main surface and the second front wall main surface to close the open end of the first pocket. The final steps include folding the flap along a top fold line, wherein the flap is perpendicular to the first end wall and the flap is parallel with the first back wall main surface; and securing the flap into the slot of the second front surface.

DETAILED DESCRIPTION OF THE PREFERRED EMBODIMENTS

The present invention provides a package assembly for enclosing a plurality of consumable products and for permitting ease of dispensing of the products therefrom.

Figure 1:
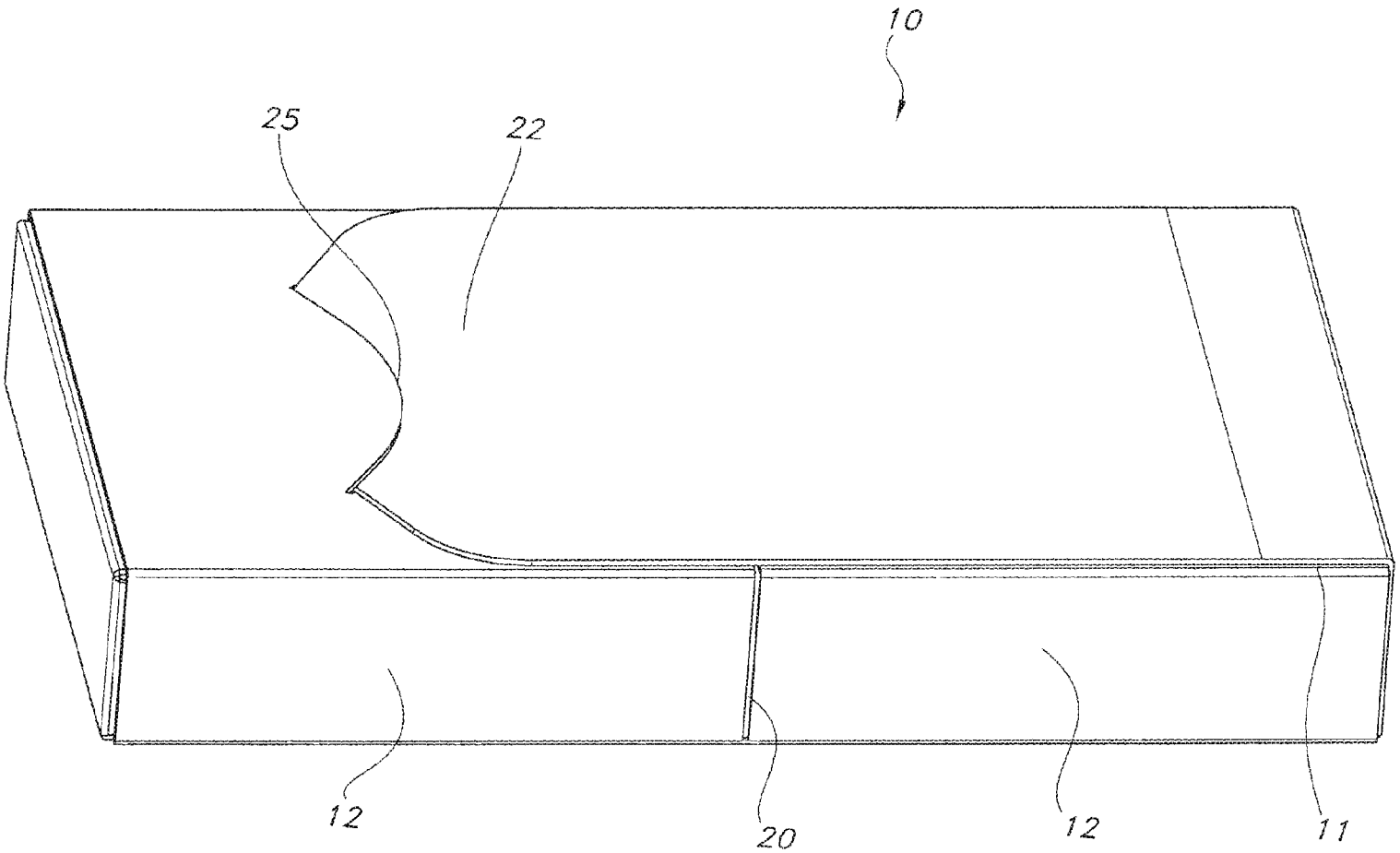
FIGS. 1-3 show a product package assembly of the present invention in closed, partially open, and fully opened condition respectively.
Figure 2:
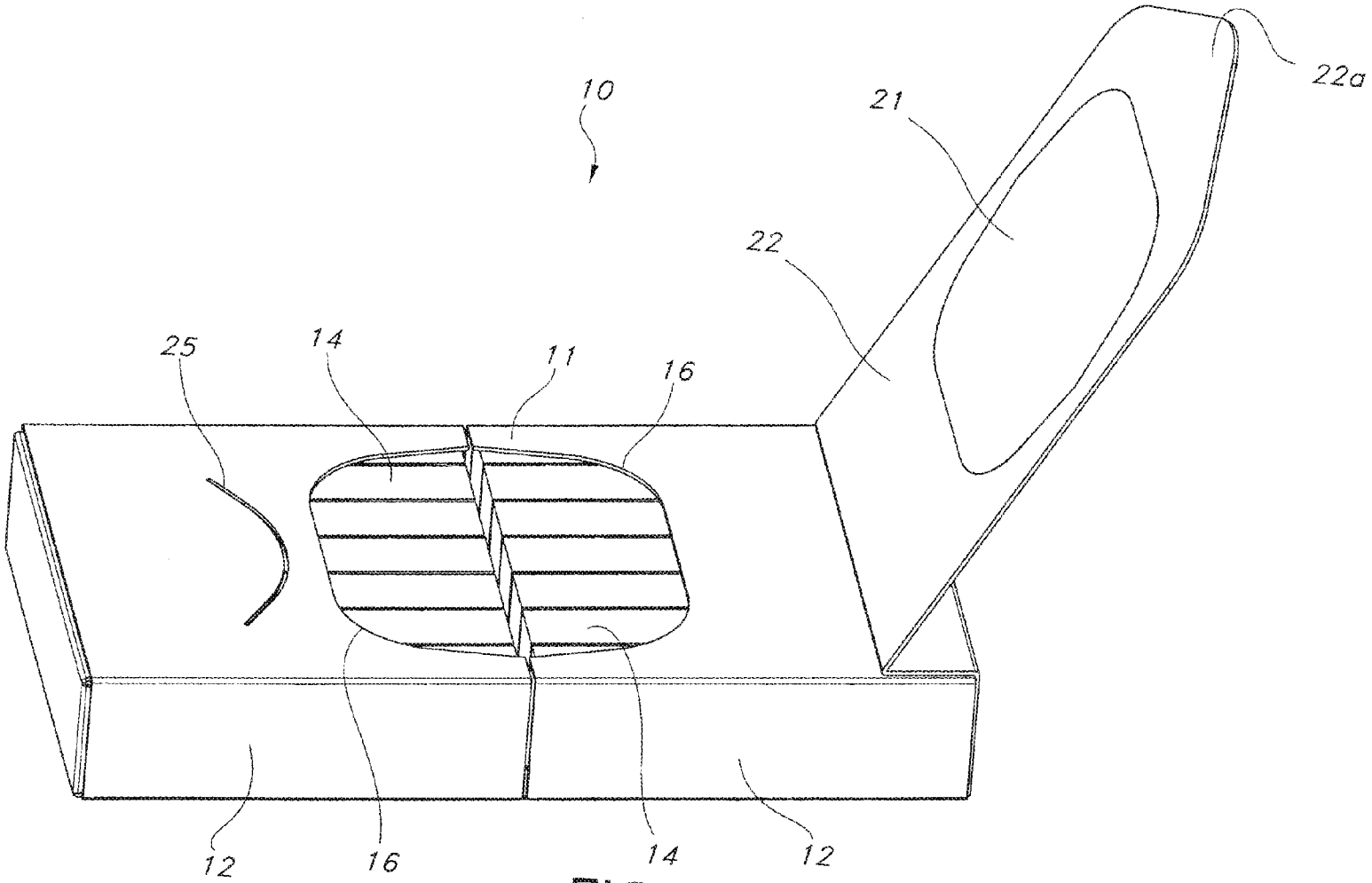
Figure 3:
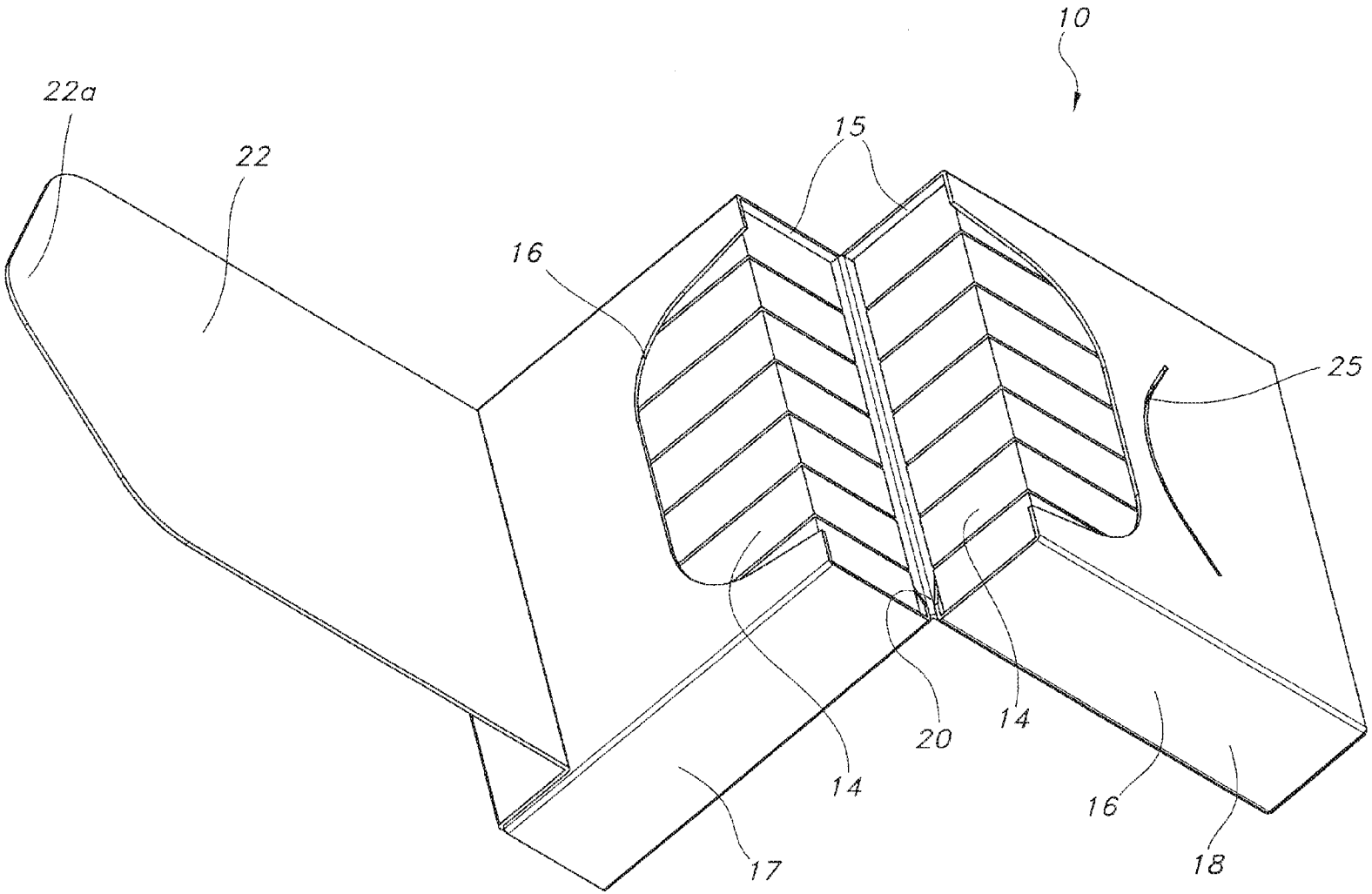

Referring to FIGS. 1-3, the package assembly 10 of the present invention is shown. Package assembly 10 includes a package housing 11 which is formed from a die-cut flat blank 30 shown in FIG. 4. Blank 30 is folded into the configuration shown in FIGS. 1-3 so as to define a pair of foldable product accommodating pockets 12 each supporting an array of wrapped gum slabs 14 arranged preferably in a face-to-face orientation. Each pocket is generally rectangular in configuration having an upper open end 15 defined by a generally semicircular opening 16 along a face of the pocket and extending along the upper end thereof. The pockets 12 are constructed to be arranged such that the upper open ends are in facing relationship on either side of fold line 20. The flat blank 30 also defines a foldable flap 22 which extends from the bottom portion of one of the pockets.

As shown in FIG. 1 in a flat closed position, the flap 22 extends across the side-by-side openings 16 of the facing pockets. The flap includes a distal end 22*a* which may be tucked into a slot 25 formed in one of the other pockets which permits opening and reclosing of the package housing 11 to permit access to the slabs 14 contained within the pockets 12.

In the closed condition shown in FIG. 1, the pockets remain flat and in line with one another. The flap has its distal end 22*a* tucked within the slot 25. In this condition the package housing 11 is maintained in a flat closed position for carrying by the consumer.

Once it is desired to dispense one or more of the gum slabs contained within the pockets, the consumer opens the flap 22 by removing the distal end 22*a* from the slot 25. FIG. 2 show foil 21 that can be removed by an adhesive spot 19 on flap 22. The foil 21 is removed to expose and provide access to the product therein. The pockets 12 may be folded along fold line 20 so that the pockets are placed side-by-side with the open upper ends 15 extending mutually upwardly as shown in FIG. 3. The consumer may then dispense one or more of the gum slabs from either or both of the pockets.

The individual gum slabs may be removably secured within the pockets by a releasable adhesive (not shown) for example at the bottom of each pocket 12.

Once the desired number of gum slabs 14 is removed from one or both of the pockets, the pockets may be returned to the flat condition shown in FIG. 2 and the flap 22 can be reclosed by inserting the distal end 22*a* into the slot 25.

Figure 4:
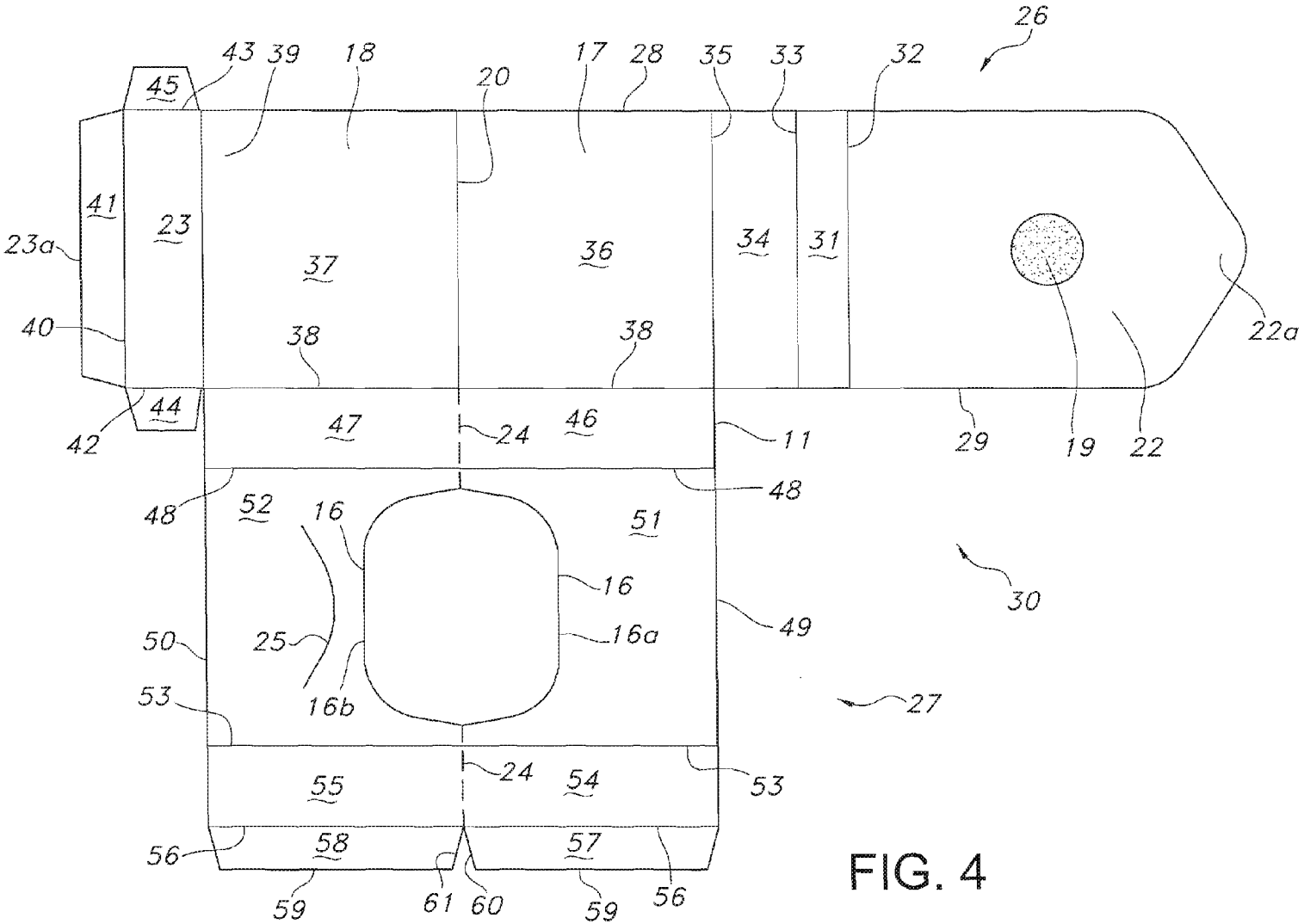
FIG. 4 is the flat blank used to form a package assembly of the present invention.
Figure 5:
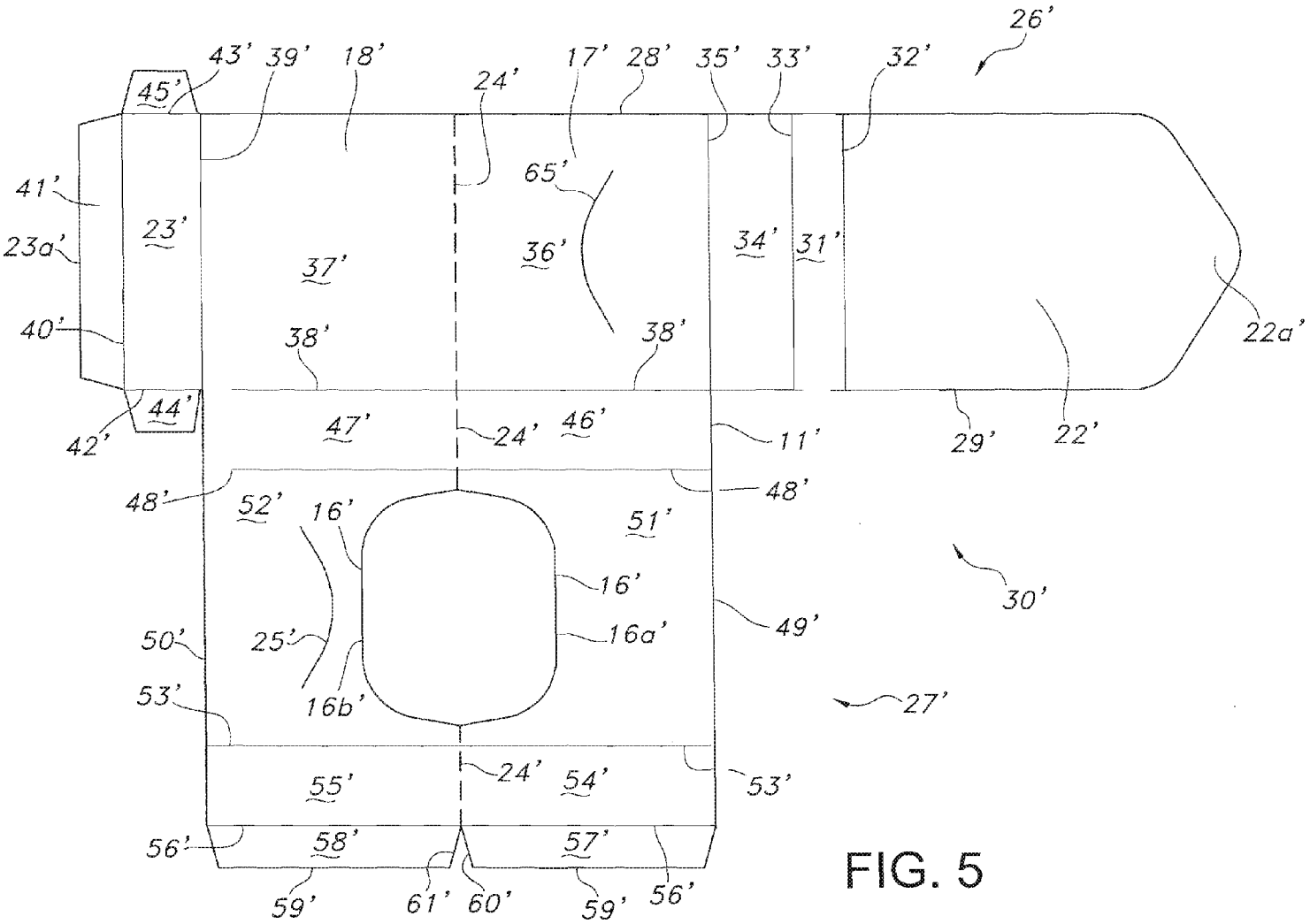
FIG. 5 is the flat blank used to form a package assembly of the present invention.

FIGS. 4 and 5 show blank 30, 30' of package housing 11. Blank 30,30' includes a main vertical section 26, 26' and a square shaped protruding section 27,27' extending from one of the sides of the vertical section, having an L-shaped geometry. The vertical section extends from the distal end 22*a*,22*a*' of the foldable flap 22,22' to the proximal end 23*a*,23*a*' of the end flap 23,23' and between unattached edge 28,28' to the opposing edge 29,29' which is partially unattached and foldably connected to protruding section 27,27'. Flap 22,22' is pentagonal with a rectangular portion and one end having a triangular shape which extends to distal end 22*a*,22*a*'. Opposite distal end 22*a*,22*a*', flap 22,22' is foldably connected to top portion 31,31' at top fold 32,32'. Top portion 31,31' extends between top fold line 32,32' and fold line 33,33'. Fold line 33,33' distinguishes the top portion 31,31' from first end wall 34,34'. First end wall 34,34' extends between fold line 33,33' and side fold line 35,35'. Flap 22,22', top portion 31,31' and first end wall 34,43' extend between unattached ends 28,28' and 29,29'.

FIGS. 4 and 5 show first main surface 36, 36' and second main surface 27,27' having a square shape of equal dimensions. First main surface 36,36' and second main surface 37,37' serve as the back wall of the package housing 11. First main surface 36,36' extends between side fold line 35,35' and fold line 20,20'. Additionally, first main surface 36,36' extends between unattached edge 28,28' and back fold line 38,38'.

Similarly, second main surface 37,37' extends between unattached edge 28,28' and fold line 38,38'. Second main surface 37,37' extends between the fold line 20,20' and the end fold line 39. End flap 23,23' extends between end fold line 39,39' and proximal end 23*a*,23*a*'. End flap 23 is generally rectangular with three tabs extending from three of its sides. Opposite the end fold line 39 is tab fold line 40,40' of which bottom tab 41,41' extends therefrom to proximal end 23*a*. Perpendicular to tab fold line 40,40' are tab side fold lines 42,42' and 43,43'. Side tabs 44, 45 extend from fold line 42, 43,(42',43') respectively. All of the fold lines as shown in FIGS. 4 and 5 provide foldable connectability between the shared surfaces.

The protruding section 27,27' is foldably connected to the vertical section 26,26' at back fold line 38,38'. The protruding section 27,27' extends between back fold line 38,38' and unattached edge 59,59', and unattached edge 49,49' and unattached edge 50, 50'. First side flap 46,46' and second side flap 47,47' extend from back fold line 38,38' to fold line 48,48'. First side flap 46,46' extends from upper unattached edge 49,49' to perforated fold line 24,24' and second side flap 47,47' extends from perforated fold line 24,24' to lower unattached edge 50,50'. Perforated fold line 24,24' is an extension of fold line 20,20' of the vertical section 26,26' with perforation to allow for the separation of the pockets 12, as shown in FIG. 3. First front surface 51,51' extends between fold line 48,48' and fold line 53,53'. First front surface 51,51' additionally extends between upper unattached edge 49,49' and semicircular edge 16*a*,16*a*'. Second front surface 52,52' is a mirror image of first front surface 51,51'. Second front surface 52,52' extends between fold line 48,48' and fold line 53,53'. Second front surface 52,52' extends additionally between semi-circular edge 16*b*,16*b*' and lower unattached edge 50,50'. First front surface 51,51' and second front surface 52,52' are foldably connectable at perforated fold line 24,24'. First front surface 51,51' is foldably connected to first side flap 46,46' and third side flap 54,54'. Second front surface 52,52' is foldably attached to second flap 47,47' and fourth side flap 55,55'. Third flap 54,54' and fourth side flap 55,55' extend between fold line 53,53' and fold line 56,56'. Third side flap 54,54' also extends between upper unattached edge 49,49' and perforated fold line 24,24'. Fourth side flap 55 extends between perforated fold line 24,24' and lower unattached 50,50'.

Extending from third side flap 54,54' and fourth side flap 55,55' is side tab 57,57' and side tab 58,58', respectively. Side tab 57 extends between fold line 56,56' and side unattached edge 59,59'. Side tab 57,57' extends also between upper unattached edge 49,49' and edge 60,60'. Side tab 58,58' extends between edge 61,61' and lower unattached edge 50,50'. Edge 60,60' and 61,61' converge at one end of perforated fold line 24, 24' such that each of the side unattached edges 59,59' is shorter in length than fold lines 56,56' along side flap 54, 54' or side flap 55, 55'.

FIGS. 4 and 5 show that protruding section 27,27' includes first side flap 46,46', second side flap 47,47', first front surface 51,51', second front surface 52,52', third side flap 54,54', fourth side flap 55,55', side tab 57,57' and side tab 58,58'. Semi-circular opening 16,16' extends between first front surface 51,51' and second front surface 52,52'. Additionally, perforated fold line 24,24' extends from semi-circular opening 16,16' to unattached edge 28,28' and semi-circular opening 16,16' to the convergent point of edge 60,60' and 61,61'. Therefore, a portion of both first surface 51,51' and second surface 52,52' extend between perforated fold line 24,24' and upper unattached edge 49,49', lower unattached edge 50,50', respectively.

Perforated fold line 24,24' allows for the assembled package housing 11 to be broken along the perforation for access of the slab arrays therein. The first section 17,17' may be severed at perforated fold line 24, 24' to sever the second section 18,18' providing two separate pockets 12,12'. Second front surface 52,52' additionally includes slot 25,25' which is designed to be matable with distal end 22*a*,22*a*' of flap 22,22' once the package housing has been foldably assembled. FIGS. 4 and 5 show slot 25,25' having a slight curved to accommodate the distal end 22*a*,22*a*'.

A further optional feature of the present invention is shown in FIG. 4 where an adhesive portion 19 or glue spot is added to flap 22 to allow for the flap to adhere to the foil 21 or other cover over the product that would expand the circular opening 16. Upon opening the flap 22 the foil 21 or cover is attached to the flap 22 and is removed from the opening 16 to allow for access to the product therein.

A further optional feature of the present invention is shown in FIG. 5 where the fold line 20 of FIG. 4 is a severing line such as, for example, a perforation line 24' which would allow removal of one pocket 12 from the other pocket 12. This allows sharing of the product with another. Also, once one pocket is removed from the other pocket, it is contemplated that the flap 22' may be reclosable against the remaining pocket 12 by placing slot 65' on the opposite surface of the one pocket 12 to accommodate the distal end 22*a*' of the flap 22'. Slot 65' is shown in FIG. 5 as a curved slot to accommodate the flap 22' wrapping about the pocket 12 to cover the opening 16' and slide into slot 65' to close the pocket 12.

Each pocket 12 is defined by first section 17, 17' or second section 18,18' with a first end wall 34 or end flap 23, respectively. Only one pocket 12 as defined by the first section 17,17' also includes flap 22,22', however, it is contemplated that an additional flap (not shown) may extend from end flap 23, to allow for covering the pocket 12 as defined by the second section 18,18' once the pockets are severed.

Once blank 30, 30' has been die cut from a single piece of material, it may be folded to assemble the package housing 11. Vertical section 26,26' and protruding section 27,27' are folded along back fold line 38,38' such that the vertical section 26,26' is perpendicular to protruding section 27,27'.

Next, first front surface 51,51' and second front surface 52,52' are folded along the fold line 48,48' such that the first front surface 51,51' and second front surface 52,52' are parallel to first main surface 36,36' and second main surface 37,37'. Additionally, first side flap 46,46' and second side flap 47,47' are perpendicular to first main surface 36,36', second main surface 27,27', first front surface 51,51' and second front surface 52,52'.

Next, third side flap 54,54' and fourth side flap 55,55' are folded along fold 53,53' such that third side flap 54,54' and fourth side flap 55,55' are perpendicular to first front surface 51,51' and second front surface 52,52'. Side tabs 57,57' and side tabs 58,58' are then folded such that they are perpendicular to third side surface 54,54' and fourth side surface 55,55' along fold line 56,56'. Side tab 57,57' and side tab 58,58' and/or first main surface 36,36' and second main surface 37,37' may include an adhesive such that the side tabs 57,57', 58,58' can be attached to the corresponding main surfaces. For example, side tab 57,57' would be aligned with and attached to first main surface 36,36'. Similarly, side tab 58,58' would be aligned with and attached to second main surface 37,37'. This foldable configuration now provides an interior cavity with two open ends. Tabs 41,41', 44,44' and 45,45' are now folded along fold line 40,40', 42,42' and 43,43' respectively, such that the tabs 41,41', 44,44', 45,45' are perpendicular to end flap 23,23'. End flap 23,23' is now folded against along fold line 39,39' such that end flap 23,23' is perpendicular to second main surface 37,37'. Tabs 41,41', 44,44' and 45,45' are positioned within the interior cavity of the folded assembly to secure end flap 23,23' in the perpendicular position to second main surface 37,37'. End flap 23,23' provides a closed end for the second section 18,18'.

First end wall 34,34' is positioned perpendicular to main surface 36,36' by folding along fold line 35,35'. First end wall 34,34' is now opposed and parallel to end flap 23,23'. First end wall 34,34' closes off the end of the first section 17,17'. The blank 30,30' is folded along fold line 33,33' such that top portion 31,31' is parallel to first surface 51,51' and in contact with first surface 51,51'. Top portion 31,31' and/or first surface 51,51' includes an adhesive to secure top portion 31,31' against first surface 51,51' to secure first end wall 34,34' in place in closing off the opened end.

Flap 22,22' extends collinearly along first surface 51,51', semi-circle opening 16,16' and second front surface 52,52'. Distal end 22*a*,22*a*' extends into slot 25,25' to secure flap 22,22' in place and cover semi-circle opening 16,16'.

Having described the preferred embodiments herein, it should now be appreciated that variations may be made thereto without departing from the contemplated scope of the invention. Accordingly, the preferred embodiments described herein are deemed illustrative rather than limiting, the true scope of the invention being set forth in the claims appended hereto.

What is claimed is:

1. A package assembly comprising:

a package housing having a pair of product accommodating pockets, said pockets being disposed on opposite sides of a fold line for foldable movement between a flat closed condition and a folded open condition for allowing dispensing of said products from said pockets, said housing further including an openable flap disposed over said pockets in said flat condition for closing said pockets, wherein said flap extends from one of said pockets and wherein the other of said pockets includes a slot for receipt of a distal end of said flap in said closed condition;

wherein said flap has an adhesive portion thereon to attach to a removable cover extending between said pockets to cover the product within said pockets until said flap is in said folded open position removing said removable cover.

2. A package assembly of claim 1, wherein each of said pockets includes an open end for dispensing said products therefrom and wherein said open ends are disposed in facing relationship on either side of said fold line.

3. A package assembly of claim 2, wherein said open ends are semi-circular.

4. A package assembly of claim 1, wherein said pockets are severable at said fold line.

5. A package assembly of claim 4, where each pair of said pockets includes a slot for receipt of a distal end of said flap in a closed condition and in a closed condition of one of said pockets after said pair of said pockets is severed.

6. A blank for forming a package housing for a pair of product accommodating opposed pockets, said blank comprising a pentagonal flap foldably attached to a first end wall, said first end wall being foldably attached to a first back wall main surface, a second back wall main surface being foldably attached to and extending between said first back wall main surface and an end flap, a first side flap being foldably attached to and extending between said first back wall main surface and a first front surface, a third side flap being foldably connected to and extending between said first front surface and one side tab, a second side flap being foldably connected to and extending between said second back wall main surface and a second front surface, a fourth side flap being foldably connected to and extending between said second front surface and another side tab, and said second front surface includes a slot therethrough to mate with an end of said pentagonal flap once assembled into said package housing.

7. The blank of claim 6, wherein said first main surface and said second main surface are foldably connected at a fold line extending therebetween.

8. The blank of claim 7, wherein a perforated fold line extends partially between said first front surface and said second front surface.

9. The blank of claim 8, wherein said first front surface has an semi-circular opening therethrough.

10. The blank of claim 9, wherein said second front surface has a semi-circular opening therethrough.

11. The blank of claim 10, wherein said semi-circular openings of said first front surface and said second front surface are in communication with each other.

12. The blank of claim 6, wherein said first back wall main surface has a back slot therethrough to mate with an end of said pentagonal flap once said package housing is assembled.

13. The blank of claim 12, wherein said back slot is curved.

14. The blank of claim 6, wherein said slot is curved.

15. The blank of claim 6, wherein said package housing has an L-shaped geometry.

16. Method of forming a package housing including a pair of pockets for storing product in a face-to-face configuration; the steps comprising:

cutting a blank from a sheet, said blank including a package housing for a pair of product accommodating opposed pockets, said housing comprising a pentagonal flap foldably attached to a first end wall, said first end wall being foldably attached to a first back wall main surface, a second back wall main surface extends between said first back wall main surface and an end flap, a first side flap extends between said first back wall main surface and a first front surface, a third side flap extends between said first front surface and one side tab, a second side flap extends between said second back wall main surface and a second front surface, a fourth side flap extends between said second front surface and another side tab, and said second front surface includes a slot therethrough to mate with an end of said pentagonal flap once assembled into said package housing;

folding said first back wall main surface and said second back wall main surface along a back fold line, wherein said first back wall main surface and said second back wall main surface are perpendicular to said first side flap and said second side flap;

folding said first side flap and said second side flap along a side fold line, wherein said first side flap and said second side flap are perpendicular to said first front surface and said second front surface, and said first front surface and said second front surface are spaced apart, parallel and aligned with said first back wall main surface and said second back wall main surface;

folding said third side flap and said fourth side flap along a third fold line, wherein said third side flap and said fourth side flap are perpendicular to said first front surface and said second front surface, and said third side flap and said fourth side flap are spaced apart, parallel and aligned with said first side flap and said second side flap;

folding said one side tab and said another side tab along a side tab fold line, wherein said one side tab and said another side tab are parallel with said first back wall main surface and said second back wall main surface;

adhering said one side tab to said first back wall main surface to form a first pocket with an open end;

adhering said another side tab to said second back wall main surface to form a second pocket with an open end;

folding said end flap along an end flap line, wherein said end flap is perpendicular to said second back wall main surface, said end flap extends between said second back wall main surface and said second front wall main surface to close said open end of said second pocket;

folding said first end wall along a first end wall fold line, wherein said first end wall is perpendicular to said first back wall main surface, said first end wall extends between said first back wall main surface and said second front wall main surface to close said open end of said first pocket;

folding said pentagonal flap along a top fold line, wherein said pentagonal flap is perpendicular to said first end wall and said pentagonal flap is parallel with said first back wall main surface; and securing said pentagonal flap into said slot of said second front surface.

17. A method of claim 16 further including the step of cutting a slot in said first back wall main surface for slidably mating with said pentagonal flap upon separation of said pair of pockets.

18. A method of claim 16 further including the step of cutting a line of perforation between said first side flap and said second side flap, said first front surface and said second front surface, said third side flap and said fourth side flap.

19. A method of claim 18 further including cutting an opening through said first front surface and said second front surface.

20. A method according to claim 19 further including the step of continuing to cut a line of perforation between said first back wall main surface and said second back wall main surface to allow for separation of said pair of pockets upon severing said package housing along the line of perforation.

* * * * *